US005890261A

United States Patent [19]

Mantarakis

[11] Patent Number: 5,890,261

[45] Date of Patent: Apr. 6, 1999

[54] DOOR HANDLE BASES FOR MOUNTING DOOR HANDLES TO DOORS

[75] Inventor: Petros Z. Mantarakis, Northridge, Calif.

[73] Assignee: Reflectolite, Pacoima, Calif.

[21] Appl. No.: 904,443

[22] Filed: Jul. 31, 1997

[51] Int. Cl.[6] ..... A47B 95/02

[52] U.S. Cl. ..... 16/114 R; 16/110 R; 16/DIG. 24; 16/DIG. 40

[58] Field of Search ..... 16/114 R, 110 R, 16/DIG. 24, DIG. 25, DIG. 30, 404, DIG. 40, DIG. 41; 49/460; 312/348.6; 411/546, 531, 84, 85; 403/21, 6

[56] References Cited

U.S. PATENT DOCUMENTS 3,083,796 4/1963 Bell, Jr. ..... 411/546
4,453,346 6/1984 Powell et al. ..... 411/546
4,790,701 12/1988 Baubles ..... 411/85
4,922,576 5/1990 Weidner et al. ..... 16/114 R

*Primary Examiner*—Chuck Y. Mah
*Attorney, Agent, or Firm*—Hill & Simpson

[57] ABSTRACT

The present invention provides door handle bases for use in mounting door handles to doors. The door handle base has a base plate having a door handle side and an opposite door side, and a pair of tabs attached to the base plate. The pair of tabs are spaced apart from each other and each tab defines a fastener hole through the tab. A boss protrudes from each tab away from the door side of the base plate and contacts the door when the door handle is mounted to the door by the door handle base. The tabs are removably attached to the base plate by a frangible connection and are useable with multiple door handles and doors.

20 Claims, 3 Drawing Sheets

12
28
32
38
16
54
52
10
36
24
30
20
44
50
40
48
42

DOOR HANDLE BASES FOR MOUNTING DOOR HANDLES TO DOORS

FIELD OF THE INVENTION

The present invention generally relates to door handle bases for mounting door handles to doors and more specifically, the present invention relates to door handle base for mounting door handles to sliding doors.

BACKGROUND OF THE INVENTION

Door handles are commonly used on doors to assist in opening and closing the doors, among performing other functions. For example, a door handle may include a latch or a lock mechanism. Numerous door handles have been made for various types of doors. Door handles may have structural differences from each other and may include various shapes, sizes and visual appearances. Fasteners, such as screws, are commonly used to mount door handles to doors. Door handles may also be "built-in" with the door.

Door handles which are mounted to doors may include a door handle base position between the handle and the door. The door base assist in mounting the door handle to the door and may assist in containing a door latch or lock mechanism. One type of door handle which can utilize a base for mounting the handle to a door is a sliding door handle. For example, FIG. 7 shows an existing door handle base connected to a door handle which is described further below. Door handles for sliding doors have including fastener openings which receive fasteners to mount the door handle to the sliding door. Other sliding door handles have also included extended mounting bosses which extend from the door handle to the door and engage the door. The mounting bosses define fastener openings such that the fasteners extend through the bosses.

The variety of door handles may require various door handle bases to properly mount the door handles to the doors. Accordingly, an advantage would be to have door handle bases in which an individual door handle base can be used with multiple door handles and doors. One specific advantage would be to have a door handle base which can be used with sliding door handles and sliding doors whether or not the door handle has an extended boss for mounting the handle to the sliding door.

SUMMARY OF THE INVENTION

The present invention provides new door handle bases for mounting door handles to doors, such as mounting sliding door handles to sliding doors. The new door handle bases assist in mounting the handles to the doors and can be used with multiple door handles and doors.

One door handle base according to the present invention includes a base plate having a door handle side and an opposite door side, and a pair of tabs attached to the base plate. The pair of tabs are spaced apart from each other and each tab defines a fastener hole through the tab. A boss protrudes from each tab away from the door side of the base plate and contacts the door when the door handle is mounted to the door by the door handle base. The tabs can be removably attached to the base plate by a frangible connection. The frangible connection may be made by a reduced material thickness and may extend around a periphery of the tab. The tabs can be movably attached to the base plate to provide multiple fastener openings depending on the position of the tabs. A latch section may be defined in the base plate between the pair of tabs.

One new door handle base of the present invention is particularly suited for use with sliding door handles and sliding doors. The door handle base can be used with sliding door handles that do not include an extended mounting boss by utilizing the tabs which are connected to the base plate. The bosses on the tabs may contact the door and provide increased strength in the mounting between the door handle and the door. The door handle can also be used with sliding door handles that have an extended mounting boss which contacts the door. In this case, the tabs are removed from the base plate, e.g. by breaking the frangible connection. The extended mounting bosses on the door handle can extend through the door handle base and contact the door.

The new door handle bases provide a convenient, cost effective way of mounting door handles to doors. The door handle bases are adjustable so that one door handle base can be used with multiple door handles and doors.

Therefore, an advantage of the present invention is to provide door handle bases for mounting door handles to doors, such as mounting sliding door handles to sliding doors, for example.

Another advantage of the present invention is to provide door handle bases which are adjustable and useable with multiple door handles and doors.

Another advantage of the present invention is to provide a door handle base which has a base plate having a door handle side and an opposite door side, and a pair of tabs attached to the base plate. The pair of tabs can be spaced apart from each other and define fastener holes through the tabs. A boss protrudes from each tab away from the door side of the base plate and contacts the door when the door handle is mounted to the door by the door handle base. The tabs are removably attached to the base plate by a frangible connection. The frangible connection may be made by a reduced material thickness and may extend around a periphery of the tab. A latch section may be defined in the base plate between the pair of tabs.

Other objects and advantages of the present invention will become apparent upon reading this disclosure including the appendant claims and with reference to the accompanying drawings.

DETAILED DESCRIPTION OF PRESENTLY PREFERRED EMBODIMENTS

Although the present invention can be made in many different forms, the presently preferred embodiments are described in this disclosure and shown in the attached drawings. This disclosure exemplifies the principles of the present invention and does not limit the broad aspects of the invention only to the illustrated embodiments.

Figure 1:
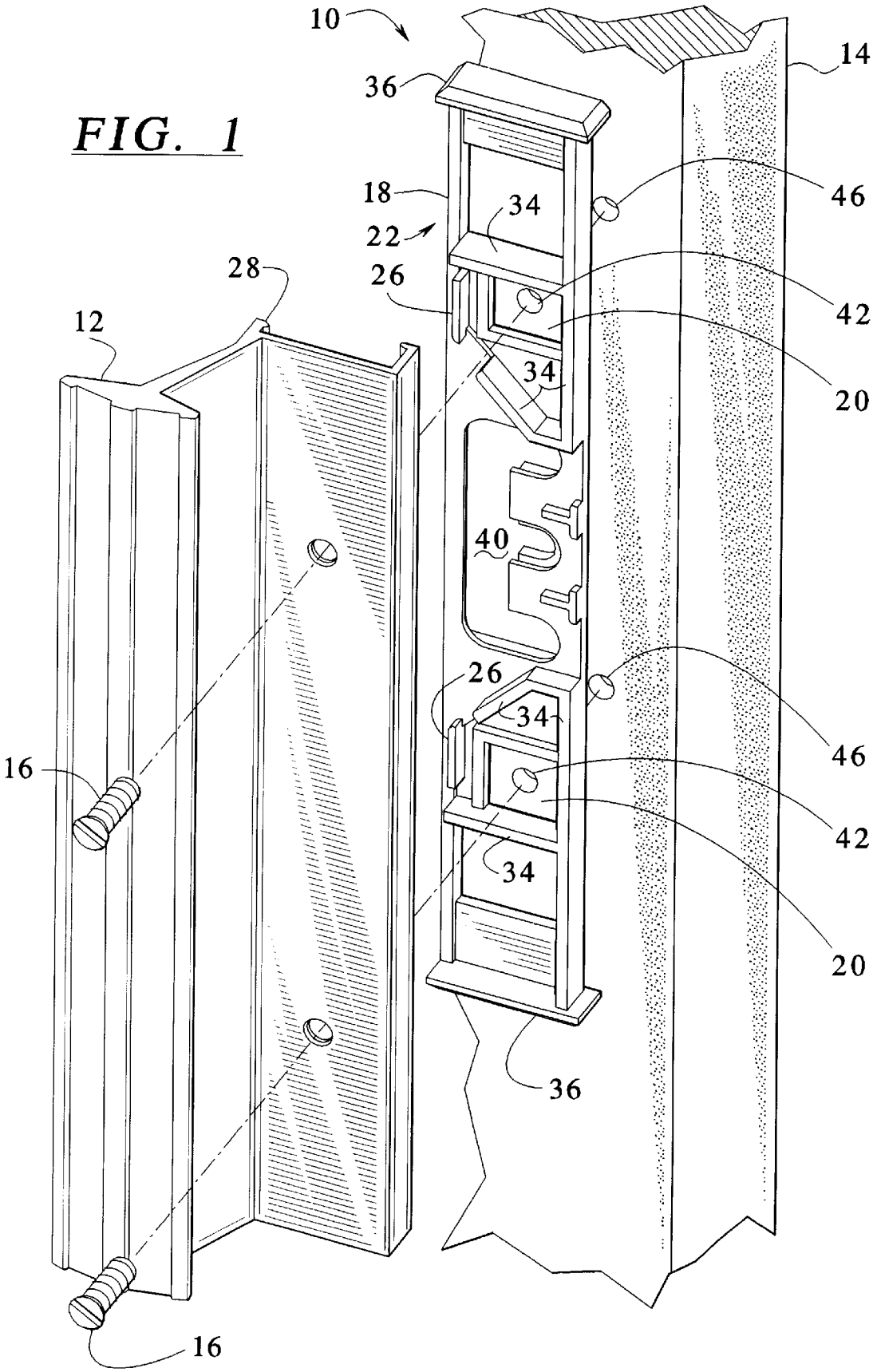
FIG. 1 is a perspective view of a door handle base according to the principles of the present invention shown exploded from a door handle and door assembly.
Figures 2, 3:
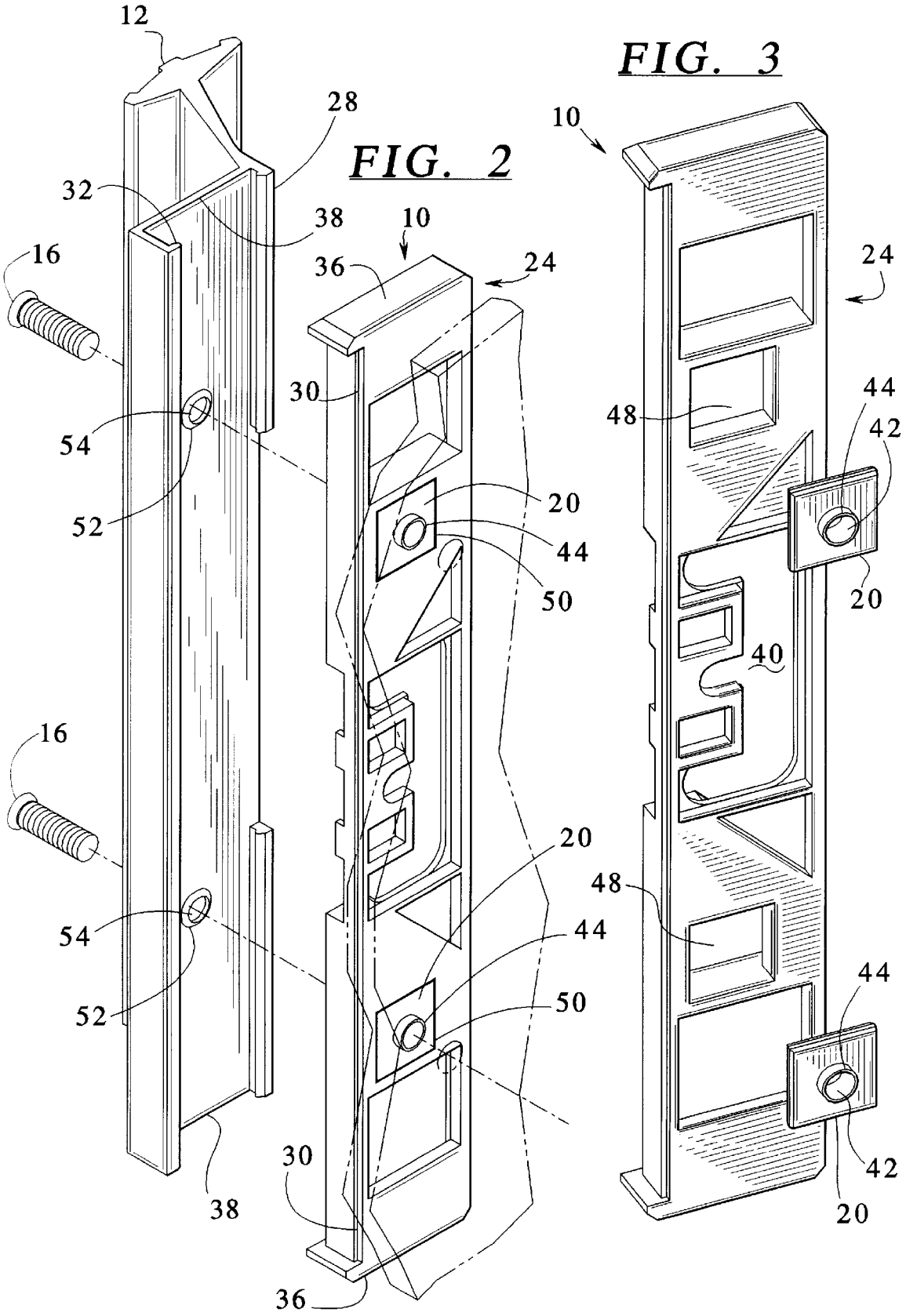
FIG. 2 is another perspective view of the door handle base of FIG. 1 shown exploded from the door handle and door assembly.
FIG. 3 is an exploded, perspective view of the door handle base of FIG. 1.

A new door handle base 10 according to the principles of the present invention is shown by way of example in FIGS. 1 and 2. The door handle base 10 of FIGS. 1 and 2 is particularly useful for mounting a door handle 12 to a sliding door 14. Of course, the door handle base 10 could be made in various shapes, sizes and configurations to be used with other door handles and doors. In the example of FIGS. 1 and 2, fasteners 16, such a screws, are used to mount the door handle 12 to the sliding door 14 with the door handle base 10 positioned between the door handle 12 and the door 14.

Figure 6:
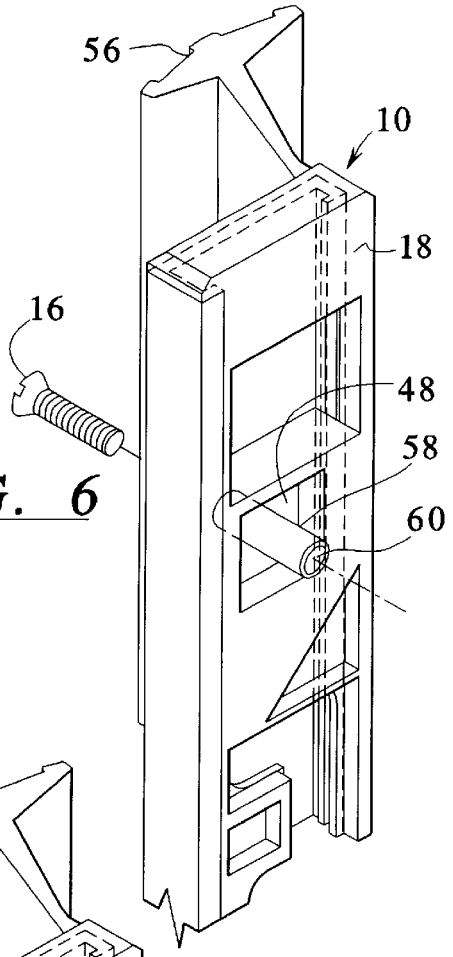
FIG. 6 is a perspective view of the door handle base of FIG. 1 showing a tab removed and mounted to another door handle.
Figure 5:
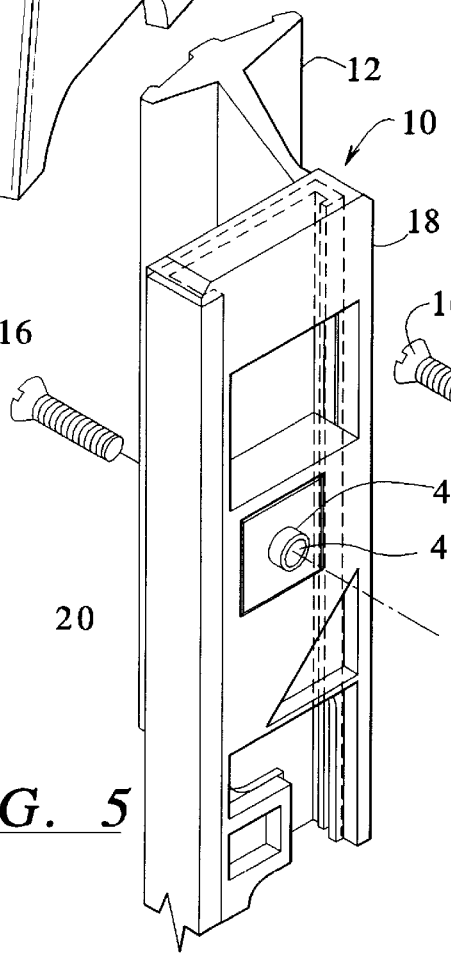
FIG. 5 is a perspective view of the door handle base of FIG. 1 mounted to a door handle.

The door handle base 10 has a base plate 18 and two spaced apart tabs 20. The base plate 18 has a door handle side 22 (FIG. 1) and an opposite door side 24 (FIG. 2). A pair of locking projections 26 extend from the door handle side 22 of the base plate 18 and engage a ridge 28 on the door handle 12 to form a snap fit of the door handle base 10 to the door handle 12. A locking shoulder 30 formed by a recess on the door side 24 (FIG. 2) engages another ridge 32 on the door handle 12 to assist in the snap fit of the door handle base 10 to the door handle 12. Referring to FIG. 1, various walls 34 extend from the door handle side 22 of the base plate 18 and contact the door handle 12. Also, the structural strength of the door handle base 10 is enhanced by the walls 34. Ends 36 of the door handle base 10 cover end openings 38 of the door handle 12 as can be seen in FIGS. 5 and 6. A latch section 40 may be provided on the door handle base 10 between the two tabs 20. The latch section 40 provides an area that can contain a door latch or lock mechanism, for example.

Referring to FIGS. 1 and 2, the tabs 20 define fastener or mounting holes 42 which permit the fasteners 16 to extend through the door handle base 10 when the door handle 12 is mounted to the door 14. As shown in FIG. 2, each tab 20 has a boss 44 extending from the door side of the tab 20 and surrounding the fastener hole 42. The bosses 44 on the tabs 20 contact the door 14 when the door handle 12 is mounted to the door 14. More specifically, the bosses 44 on the tabs 20 engage the door 14 such that the fastener holes 42 are aligned with fastener openings 46 on the door 14. The engagement between the bosses 44 on the tabs 20 with the fastener openings 46 on the door 14 enhances the strength of mounting the door handle 12 to the door 14 and tends to maintain a tight connection between the fasteners 16 and the door 14, i.e., tends to reduce loosening of the fasteners 16.

Figure 4:
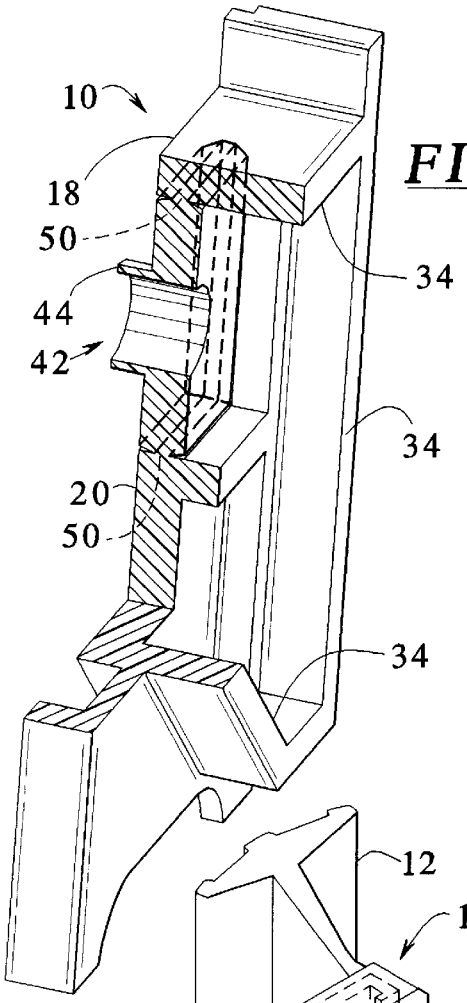
FIG. 4 is a perspective, cross-sectional view of the door handle base of FIG. 1.

Referring to FIGS. 3 and 4, the tabs 20 on the door handle base 10 are removable. When the tabs 20 are removed from the door handle base 10, mounting holes 48 remain in place of the tabs 20. The tabs 20 are removable from the base plate 18 by breaking a frangible connection 50 as shown in FIG. 4. The frangible connection 50 can be a reduced material thickness, for example. The frangible connection 50 may extend around a periphery of the tab 20 as shown in FIG. 2. Of course, other methods of providing a frangible connection or moveably connecting the tabs 20 to the base plate 18 are contemplated by the present invention. For example, the tabs 20 could be hinged to the base plate 18 or connected to the base plate 18 in some other manner which permits the tabs 20 to be moved between alternate positions. In the frangible connection embodiment, the tabs 20 have two positions in which the tabs 20 are connected to the base plate 18 in one position and the tabs 20 are removed from the base plate 18 in the other position. Another embodiment of the present invention may provide the tabs 20 to be movably connected to the base plate 18. In such an embodiment, the tabs 20 may be movable between at least two positions in which at least two different fastener or mounting holes can be utilized to mount a door handle to a door.

Referring to FIG. 5, the door handle base 10 is shown with the tabs 20 connected to the base plate 18 and the tab fastener holes 42 available for mounting the door handle 12 to the door 14. The door handle base 10 with the tabs 20 connected to the base plate 18 is particularly useful for door handles, such as door handle 12, which has a door handle boss 52 (FIG. 2) that is spaced away from the door 14, i.e. has a relatively low height. The door handle boss 52 defines fastener openings 54 in the door handle 12 and does not engage the door 14. Accordingly, the tab bosses 44 engage the door 14, particularly in the area of the door fastener opening 46. The door handle base 10 with the tabs 20 would also be useful for door handles which do not have the door handle bosses 52.

Referring to FIG. 6, the door handle base 10 is shown with the tabs 20 removed from the base plate 18 to expose mounting holes 48. The door handle base 10 with the tabs 20 removed from the base plate 18 is particularly useful for door handles, such as door handle 56, which has an extended door handle boss 58 that contacts the door 14, i.e. has a relatively long height. The extended door handle boss 58 defines fastener openings 60 in the door handle 56 which receive the fasteners 16. The mounting holes 48 in the base plate 18 created by removing the tabs 20 permit the extended fastener bosses 58 to extend through the door handle base 10. In the embodiment shown in FIG. 6, the mounting holes 48 in the base plate 18 with the tabs 20 removed are larger than the fastener holes 42 in the tabs 20. This is to permit the extended fastener boss 58 to extend through the door handle base 10.

Figure 7:
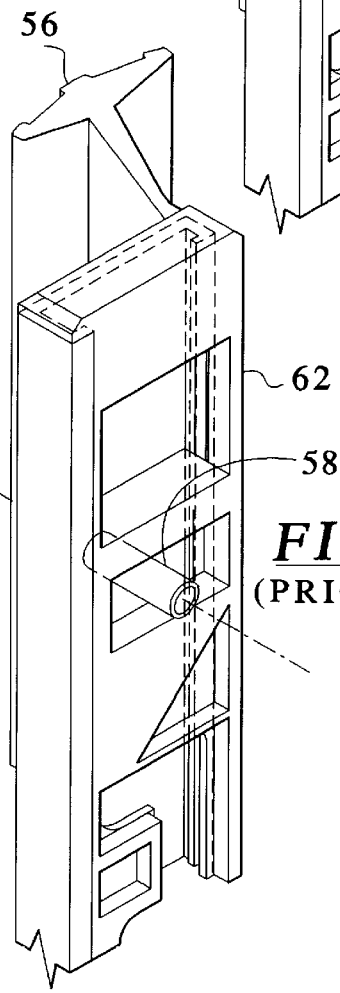
FIG. 7 (PRIOR ART)
FIG. 7 is a perspective view of an existing door handle base mounted to the door handle of FIG. 6.

FIG. 7 shows an existing door handle base 62 connected to the door handle 56. The extended fastener boss 58 passes through the door handle base 62 for mounting the door handle 56 to a door. The known door handle base 62 can also be used with the door handle 12 of FIGS. 1, 2 and 5 which has the smaller door handle boss 52. However, there would be no mounting boss on the door handle 12 or the door handle base 62 to contact the door.

The new door handle base 10 is used as follows. A door handle is selected which may have relatively low bosses 52 as in FIG. 2 (or even no bosses) or relatively long bosses 58 as shown in FIG. 6. If the door handle has short bosses or no bosses, the tabs 20 are left in place on the base plate 18. If the door handle has extended bosses which will contact the door, the tabs 20 are moved to a position which creates the mounting holes 48 through the base plate 18 and permits the extended bosses 58 to pass through the door handle base 10. For example, the frangible connection 50 may be broken to remove the tabs 20 from the door handle base 10. The door handle base 10 is assembled to the door handle, e.g. snap fitted to the door handle, and the assembly is placed in contact with the door 14. Either the bosses 44 on the tabs 20 or the extended fastener bosses 58 on the door handle contacts the door 14 to align the mounting holes. The door handle with the door handle base 10 is mounted to the door 14 by the fasteners 16.

While the presently preferred embodiments have been illustrated and described, numerous changes and modifications can be made without significantly departing from the spirit and scope of this invention. Therefore, the inventor intends that such changes and modifications are covered by the appended claims.

The invention is claimed as:

1. A door handle base for mounting a door handle to a door comprising:

a base plate having a door handle side and an opposite door side;

a pair of tabs attached to the base plate and spaced apart from each other, each tab defining a fastener hole through the tab and a boss protruding away from the door side of the base plate, wherein the bosses contact the door when the door handle is mounted to the door by the door handle base; and a latch section defined in the base plate between the pair of tabs.

2. The door handle base of claim 1 wherein each tab is removably attached to the base plate.

3. The door handle base of claim 1 further comprising a frangible connection between the base plate and each of the tabs.

4. The door handle base of claim 3 wherein the frangible connection comprises a reduced material thickness.

5. The door handle base of claim 3 wherein the frangible connection extends around a periphery of the tab.

6. The door handle base of claim 1 wherein each boss surrounds one of the fastener holes.

7. The door handle base of claim 1 wherein the tabs are movable between first positions in which the fastener holes define first mounting holes through the base plate and second positions spaced away from the first positions in which second mounting holes are defined through the base plate at locations on the base plate that correspond to the first positions of the tabs.

8. The door handle base of claim 7 wherein the second mounting holes are larger than the first mounting holes.

9. The door handle base of claim 7 wherein the tabs are removably attached to the base plate.

10. The door handle base of claim 1 wherein the door handle base is elongated for use in an elongated sliding door handle.

11. A door handle base for selectively mounting first and second door handles to a door by a fastener, the first door handle having a portion spaced away from the door which defines a first handle fastener opening, the second door handle having an extended fastener boss which contacts the door and defines a second handle fastener opening, the door handle base comprising:

a base plate; and a tab adjacent the base plate and being movable between first and second tab positions, the tab in the first tab position defining a first base plate fastener hole which receives the fastener when the door handle base is used to mount the first door handle to the door, the base plate defining a second base plate fastener hole which receives the extended fastener boss when the tab is in the second tab position and the door handle base is used to mount the second door handle to the door.

12. The door handle base of claim 11 wherein the tab has a tab boss.

13. The door handle base of claim 11 Wherein the tab is removably attached to the base plate.

14. The door handle base of claim 13 wherein the second base plate fastener hole is defined by removing the tab from the base plate.

15. A door handle base for selectively mounting first and second door handles to a door by fasteners, the first door handle having two portions spaced away from the door which define two first handle fastener openings, and the second door handle having two extended fastener bosses which contact the door and define two second handle fastener openings, the door handle base comprising:

a base plate; and a pair of spaced apart tabs adjacent the base plate, each tab being movable between first and second tab positions, each tab in the first position defining a first base plate fastener hole which receives one of the fasteners when the door handle base is used to mount the first door handle to the door, the base plate defining a pair of second tab fastener holes which receive the extended fastener bosses when the tabs are in the second tab positions and the door handle base is used to mount the second door handle to the door.

16. The door handle base of claim 15 wherein each tab has a tab boss.

17. The door handle base of claim 15 wherein each tab is removably attached to the base plate.

18. The door handle base of claim 17 wherein the second base plate fastener holes are defined by removing the tabs from the base plate.

19. A door handle base for use in mounting a door handle to a sliding door by fasteners, the door handle base comprising:

a base plate having a handle side and an opposite door side, the handle and door sides in contact with the door handle and the sliding door, respectively, when the door handle is attached to the sliding door by the fasteners; and two spaced apart tabs removably connected to the base plate, each tab having a boss surrounding a fastener opening and extending from the door side of the base plate, the base plate defining two door handle boss openings when the tabs are removed from the base plate.

20. The door handle base of claim 19 wherein each of the tabs are removably connected to the base plate by a frangible connection.

* * * * *